United States Patent [19]

Sawdon

[11] Patent Number: 4,989,443

[45] Date of Patent: Feb. 5, 1991

[54] CRIMPING APPARATUS

[75] Inventor: Edwin G. Sawdon, Marysville, Mich.

[73] Assignee: BTM Corporation, Marysville, Mich.

[21] Appl. No.: 509,498

[22] Filed: Apr. 13, 1990

[51] Int. Cl.[5] ..... B21D 41/00

[52] U.S. Cl. ..... 72/402; 72/452

[58] Field of Search ..... 72/402, 452, 400, 401

[56] References Cited

U.S. PATENT DOCUMENTS

| | | | |
|---|---|---|---|
| 936,166 | 10/1909 | Riehl . | |
| 936,435 | 10/1909 | Evans . | |
| 1,233,343 | 7/1917 | Grenelle . | |
| 1,493,515 | 5/1924 | Berthold . | |
| 1,871,915 | 8/1932 | Phelps . | |
| 2,225,345 | 12/1940 | Lamoreaux . | |
| 2,280,351 | 4/1942 | Penford et al. . | |
| 2,933,000 | 4/1960 | Wood . | |
| 3,451,116 | 6/1979 | Shields . | |
| 3,575,036 | 4/1971 | Hoffman et al. . | |
| 3,731,518 | 5/1973 | Blocher | 72/402 |
| 3,771,343 | 11/1973 | Dawson . | |
| 3,848,451 | 11/1974 | Allin . | |
| 4,250,607 | 2/1981 | Lillbacka et al. . | |
| 4,550,587 | 11/1985 | Eisenzimmer | 72/402 |
| 4,738,013 | 4/1988 | Yamashita et al. . | |

*Primary Examiner*—Lowell A. Larson
*Assistant Examiner*—Michael J. McKeon
*Attorney, Agent, or Firm*—Harness, Dickey & Pierce

[57] ABSTRACT

A crimping apparatus assembly including a pair of normally spaced body members and an actuator member, the assembly being adapted to be placed between the rams of a press or clamp for actuating same, and having an adjustable wedge device for uniformly actuating a plurality of crimping dies.

19 Claims, 3 Drawing Sheets

CRIMPING APPARATUS

BACKGROUND AND SUMMARY OF THE INVENTION

The present invention relates to crimping apparatus, and more particularly to crimping apparatus for symmetrically crimping a fitting sleeve about a hose.

Several types of such apparatus for crimping articles are generally known. They generally include a plurality of radially disposed die members that can be actuated for translation in a radial direction to permit crimping of a workpiece. However, the achievement of efficient and substantially uniform crimping at reasonable operating costs is limited by the structure and operation of such apparatus. For example, many types of crimping apparatus include a complicated mechanism for actuating the die members and involve the cooperation of an undesirably large number of moving parts, usually non-adjustable. Further, the structure of many assemblies is such that it is difficult to pass workpieces therethrough. The ability to pass relatively large workpieces through the crimping apparatus is a desirable feature in many automated settings because it increases the number of difficult possible applications.

It is therefore a primary object of the present invention to provide an efficient crimping apparatus which requires the cooperation of relatively few moving parts, that can be adapted for automation including means for making easy adjustments, which includes an improved actuation mechanism for achieving substantially uniform crimping about an entire article, and which is capable of handling articles of many different sizes and shapes.

Other advantages and features will become apparent from the following specification taken in connection with the accompanying drawings.

DESCRIPTION OF THE PREFERRED EMBODIMENTS

The crimping apparatus of the present invention is preferably adapted for use in a device suitable for imparting a force for crimping, such as a press other other clamping device (not shown). One type of press which is ideally suited to this application is the one illustrated in U.S. Letters Pat. No. 3,730,044, the disclosure of which is hereby incorporated herein by reference.

Figure 1:
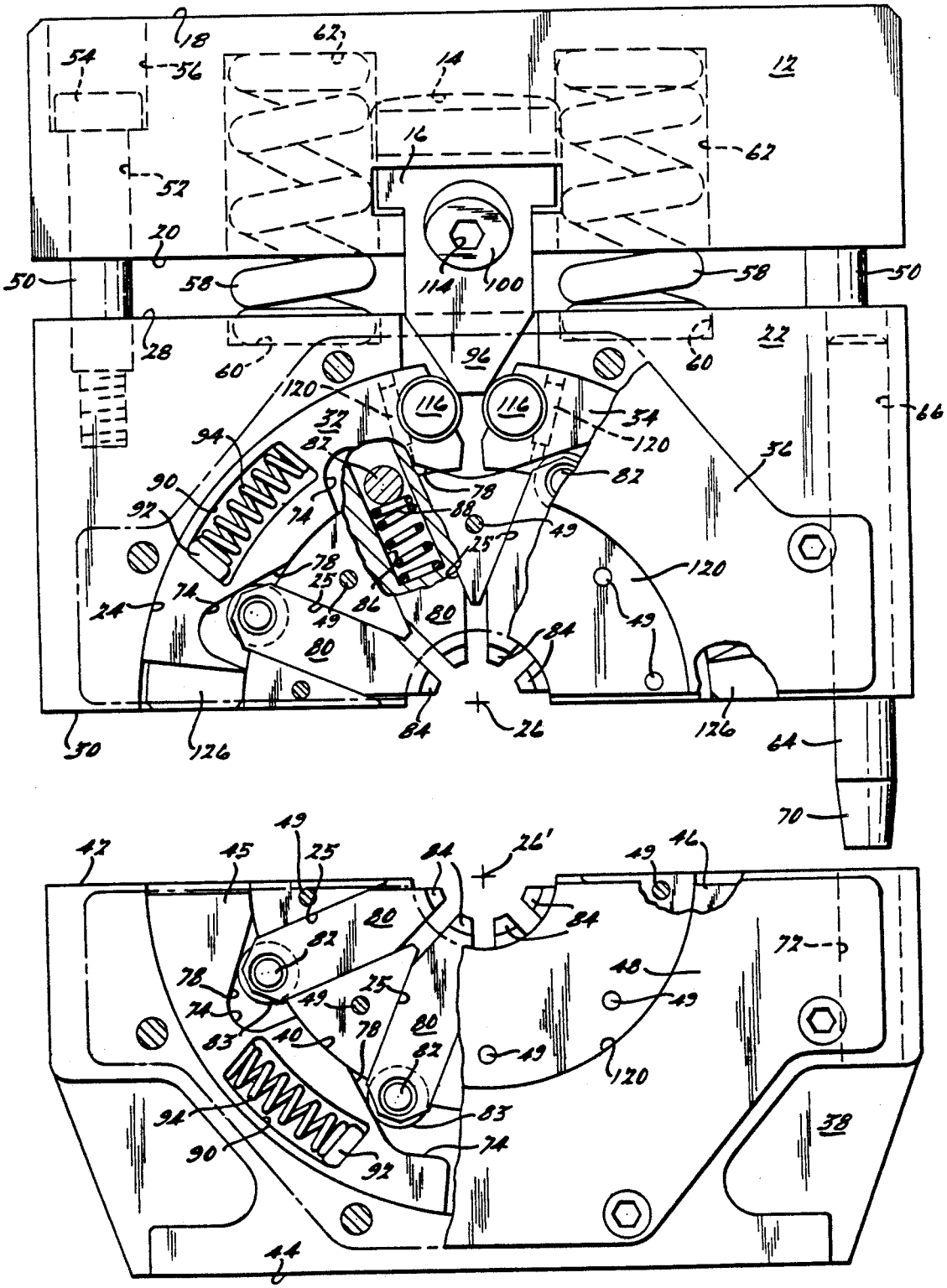
FIG. 1 is a partial end elevational view with parts broken away of a crimping apparatus embodying the principles of the present invention, shown in an opened non-crimping loading position.

The crimping apparatus generally comprises an actuator member 12 having a cavity 14 for an adjusting wedge assembly 16, and opposed generally flat and parallel end surfaces 18 and 20; an upper body member 22 having a downwardly (as shown) opening semi-circular annular recess 24 having a centered horizontal axis of curvature 26 perpendicular to the plane of the drawings, and a plurality of equal-width straight radial slots 25, member 22 having generally flat and parallel end surfaces 28 and 30; a pair of arcuate cams 32 and 34 slidably disposed in recess 24 for movement about axis 26, cam 34 being a mirror image of cam 32 about a vertical plane including axis 26; a cover plate 36 bolted to the front face of member 22 to partially enclose recess 24 and retain cams 32 and 34; a lower body member 38 having an upwardly (as shown) opening semi-circular annular recess 40 which is the mirror image of recess 24 about a horizontal plane including axis 26 (FIG. 2), and also a plurality of equal-width straight radial slots 25, member 38 having generally flat and parallel end surfaces 42 and 44; a pair of arcuate cams 45 and 46 slidably disposed in recess 40 for movement about axis 26 (FIG. 2), which is the same as axis 26' in FIG. 1 where members 22 and 38 are shown separated from one another, cam 46 being a mirror image of cam 45 about a vertical plane including axis 26' (FIG. 1); and a cover plate 48 bolted to the front face of member 38 to partially enclose recess 40 and retain cams 45 and 46. Dowels 49 may be provided extending through cover plates 36 and 48 and into the wedge-shaped portions of body members 22 and 38 disposed between radial slots 25 to strengthen the body members in high force applications.

Members 12 and 22 are connected for limited linear relative movement by means of a pair of guide bolts 50 threadably connected to member 22 and passing through bores 52 in member 12, with the heads 54 thereof disposed in counterbores 56 to limit the maximum amount of separation of the members. A plurality of compression springs 58, each extending between a blind bore 60 in member 22 and a blind bore 62 in member 12, maintain the members in a normally separated condition. Members 22 and 38 also move away from one another to receive a workpiece to be crimped and toward one another to be in a position to perform the crimping operation. This relative movement of the members can optionally be guided by a pair of guide pins 64 each held in a bore 66 in member 22 by a set screw 68 and having a downwardly (as shown) extending tapered end portion 70 adapted to be received in a locating bore 72 in member 38.

Each arcuate cam has a recess 74 generally in alignment with each of said radial slots 25 defined in part by an inclined cam surface 78 which traverses radially inwardly when the cams are moved downwardly, i.e., counter clockwise for cams 32 and 45, and clockwise for cams 34 and 46. A die 80 is slidably disposed in each slot 25 and has rotatively disposed in a partial bore at its radially outer end a follower pin 82 having affixed thereto a hardened cylindrical roller follower 83 engaging a cam surface 78, and at its inner end is provided adjacent its exposed edge with teeth 84 which actually engage and crimp the workpiece. In lieu of teeth 84, any desired crimping contour can be provided (including a data stamp) depending on the proposed application. In addition, dies 80 may be used to pierce holes, such as in tubing. All dies 80 are of the same configuration and dimensions, and can be easily replaced by simply removing plate 36 or 48.

Figure 3:
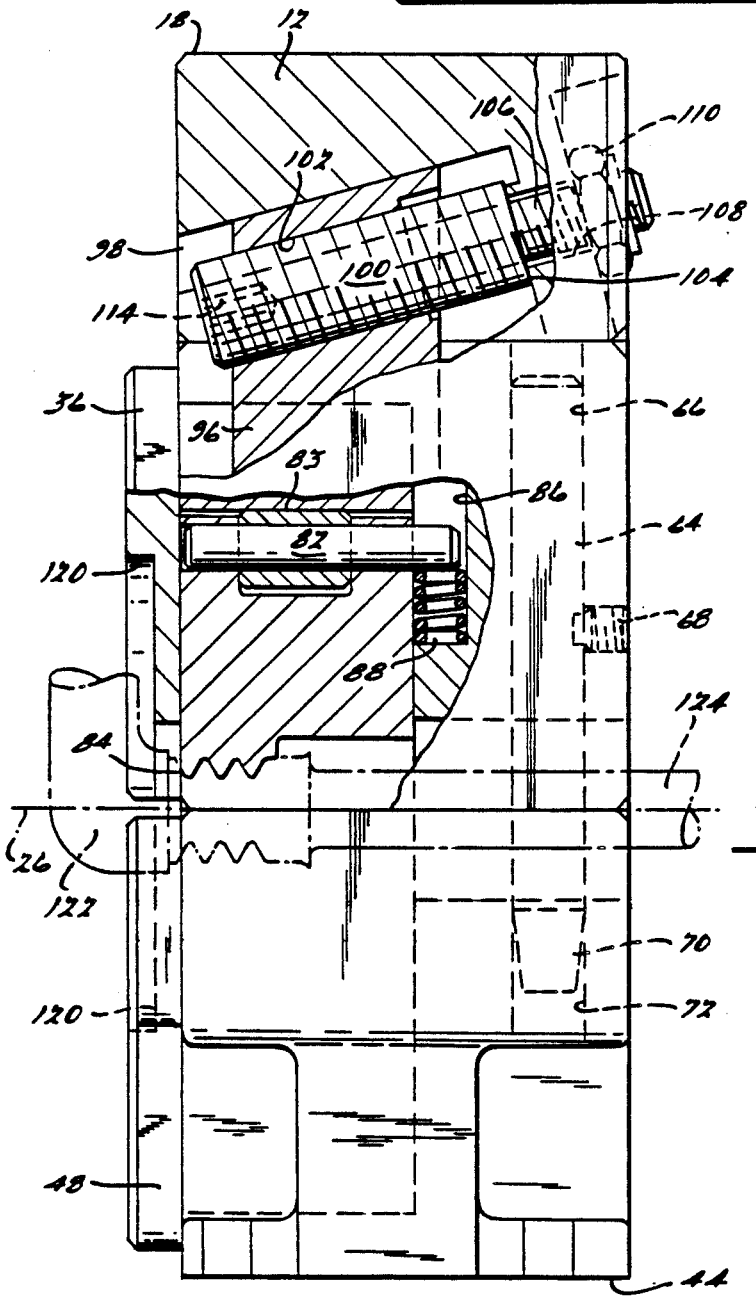
FIG. 3 is a sectional view taken generally along line 3—3 in FIG. 2.

Behind each radial slot 25 there is a generally rectangular cavity 86 in the body member having a prestressed compression spring 88 disposed therein. The radially inner end of each spring 88 engages the radially inner wall of cavity 90 and the outer end of the spring engages the free end of follower 82 (FIG. 3) to maintain a radially outwardly bias thereon, whereby follower 82 is maintained in contact with cam surface 78 at all times. Dies 80 are thus normally retracted, as shown in FIG. 1.

Each of the cams 32, 34, 45 and 46 is provided with a generally rectangular cavity 90 into which projects a flat lug 92 affixed to the body member 22 or 38. A prestressed coil spring 94 is disposed between lug 92 and the opposite end of cavity 90 to thereby bias all of the cams upwardly to their retracted or work-piece loading position (i.e., cams 32 and 44 are biased clockwise and cams 34 and 46 are biased counter clockwise).

Actuation of the cams and hence dies is achieved by wedge assembly 16 comprising an easily adjustable wedge 96 having a T-shaped cross-section slidably disposed in an inclined T-slot 98 in member 12 and held in the desired position by an inclined adjusting screw 100 threadably engaging a threaded bore 102 therein. Screw 100 has a shoulder 104 abutting member 12 and a reduced diameter threaded portion 106 extending through an opening 108 in member 12 in non-threaded engagement therewith, and a lock nut 110 for holding screw 100 in the position shown for free rotation with respect to member 12.

Figure 2:
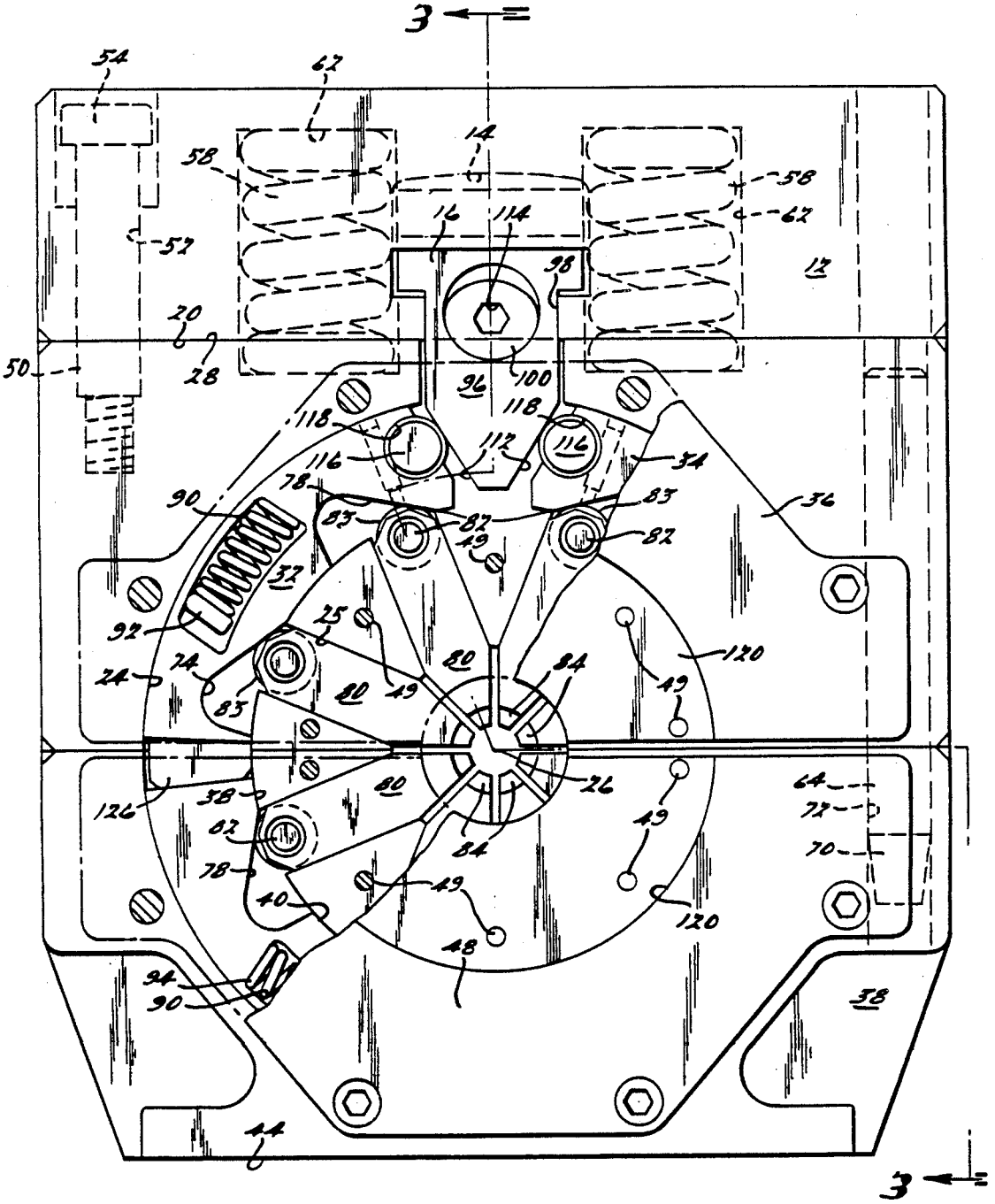
FIG. 2 is a view similar to FIG. 1 showing the crimping apparatus in a closed crimping position.
Figure 4:
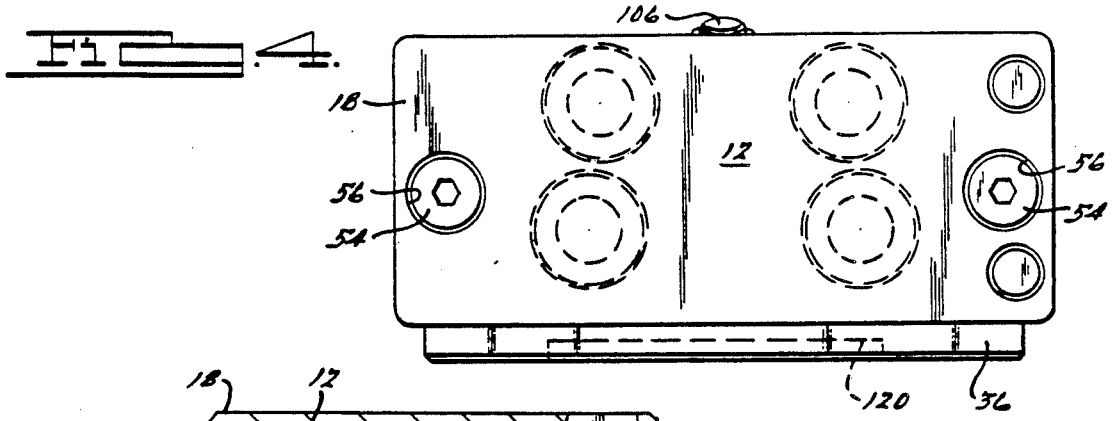
FIG. 4 is a top plan view of the crimping apparatus of FIGS. 1-3.

The lower end (as shown) of wedge 96 extends longitudinally in a parallel relation to axis 26 and has a pair of flat inclined symmetrical cam surfaces 112 extending generally radially outwardly therefrom, as best seen in FIGS. 1 and 2. Rotation of screw 100, via a hex socket 114 in the end thereof, will cause wedge 96 to slide up and down slot 98, which will vertically adjust the normal position of cam surfaces 112.

Upper cams 32 and 34 are each provided with a roller follower 116 rotatively disposed in a partial bore 118 in each cam and normally engaging cam surfaces 112 by virtue of the action of springs 88 and 94, as aforesaid. Each follower 116 can be maintained in its bore 118 by means of a pin 120 press fit in a radial hole in each cam (FIGS. 1 and 3) and engaging an appropriate circumferential groove (not shown) in follower 116. Roller followers 116 are disposed in bores which extend more than 180° around the followers, thus providing a relatively large, full-width, bearing surface. This results in very low friction and very uniform crimping.

A typical fitting assembly to be crimped by the present apparatus comprises a conventional fitting itself (it can be straight, an elbow or a tee) having the usual inner and outer metal sleeves, and a hose disposed between the sleeves and adapted to be rigidly held in place by providing a plurality of circumferentially spaced radially inward crimps, or depressions, in the outer sleeve to pinch the hose between the sleeves. Such a fitting and hose are shown generally at 122 and 124, respectively, in FIG. 3. A recess 120 can be provided in plates 36 and 48 in order to be able to crimp closely to transverse portions of the fitting. Common electrical connectors and other devices may also be readily crimped using the apparatus of the present invention.

Operation of the apparatus may be easily visualized by referring to the drawings. The apparatus is initially in the position of FIG. 1 with the body members at maximum separation to permit insertion of the workpiece, and with actuator 12 spaced from the upper body member. Surface 18 of actuator member 12 is affixed to the upper ram of the actuating clamp or press (not shown) and surface 44 of body member 38 is affixed to the lower ram of the clamp or press. The workpiece is positioned in the desired final position adjacent the ends of the crimping dies in the lower body portion. The workpiece does not thereafter move. A suitable fixture (not shown) may be used to hold the workpiece in the proper position. The external press, or clamping device, is then actuated to push surfaces 18 and 44 toward one another. This first causes the two body members to move together to the position shown in FIGS. 2 and 3, and thereafter causes springs 58 to compress, which in turn causes wedge 96 to move downwardly with respect to the upper body member and followers 116. Continuation of such movement causes cams 32, 34, 45 and 46 to move simultaneously in a direction which uniformly cams dies 80 radially inwardly to form the crimps in fitting 122. The movement of cams 32 and 34 is directly transferred to cams 45 and 46, respectively, by a projection 126 at the lower end of each of cams 32 and 34. When the two body members are initially brought together each projection 126 just engages the corresponding cam in the lower body member, so that every increment of movement of an upper cam is transmitted to its corresponding lower cam, thereby providing a uniform crimping action. The clamp or press used to generate the necessary crimping forces preferably has non-rotating rams so that the upper and lower body members will not rotate (about a vertical axis) with respect to one another when in the open loading position. During crimping such rotation is prevented by optional pins 64.

Although the apparatus is illustrated having eight dies, it can readily be redesigned for other numbers of dies. For example, the use of four dies has been found to be desirable in applications requiring extremely high crimping forces.

While it will be apparent that the preferred embodiments of the invention disclosed are well calculated to provide the advantages above stated, it will be appreciated that the invention is susceptible to modification, variation and change without departing from the proper scope or fair meaning of the subjoined claims.

What is claimed is:

1. A crimping apparatus comprising:

(a) a first body member having generally opposite first and second end surfaces and a plurality of equally spaced slots extending radially outwardly from a first longitudinal axis generally coincident with said second end surface;

(b) a second body member having generally opposite third and fourth end surfaces, said third end surface being generally complementary to said second end surface, and a plurality of equally spaced slots extending radially outwardly from a second longitudinal axis parallel to and normally spaced from said first axis and coincident with said third end surface, said second body member being positioned for movement between a normal first loading position where it is spaced from said first body member with said second and third end surfaces facing one another and a second crimping position where said second and third end surfaces engage one another and said first and second axes become coaxial;

(c) a crimping die slidably disposed in each of said slots and having at the radially inner end thereof a crimping portion;

(d) cam means on said first and second body members for simultaneously moving said dies radially inwardly to crimp a workpiece disposed coaxially with respect to said axes when said body members are in said crimping position;

(e) an actuator member connected to said first body member adjacent said first end surface and being mounted for limited movement toward and away therefrom;

(f) first spring means for biasing said actuator member away from said first body member; and (g) actuating means on said actuator member for causing said cam means to cam said dies radially inwardly when a sufficient clamping force is exerted on said first and fourth end surfaces to cause said second and third surfaces to move into engagement with one another and thereafter cause said actuator member to move against the bias of said spring means toward said first body member.

2. A crimping apparatus as claimed in claim 1 further comprising guide means for accurately guiding movement of said first body member with respect to said second body member.

3. A crimping apparatus as claimed in claim 2 wherein said guide means includes a plurality of guide pins on one of said body members and complementary bores on the other of said body members for receiving said guide pins.

4. A crimping apparatus as claimed in claim 3 wherein there is normally a space between said other of said body members and the free ends of said pins.

5. A crimping apparatus as claimed in claim 2 wherein said guide means is disposed wholly on one side of said axes to facilitate the insertion of a workpiece between said body members.

6. A crimping apparatus as claimed in claim 1 wherein said actuating means comprises a cam member having a first cam surface, and said cam means includes a follower actuatable by said cam when the latter moves radially toward said first longitudinal axis.

7. A crimping apparatus as claimed in claim 6 wherein said cam member is mounted for sliding movement along a line which is oblique to a plane transverse to the direction of movement of said body members with respect to each other, and comprising adjusting means for fixing the position of said cam member the desired distance from said follower.

8. A crimping apparatus as claimed in claim 7 wherein said line lies in a plane including said longitudinal axis and is oblique to said axis.

9. A crimping apparatus as claimed in claim 6 wherein said cam means includes a pair of circumferentially spaced arcuate cams on said first body member concentric with said first longitudinal axis and mounted for limited rotation with respect thereto, said cams lying in a plane transverse to said first longitudinal axis and having spaced adjacent ends disposed on opposite sides of a radius extending from said first longitudinal axis to said cam member, said followers being disposed on said adjacent ends of said cams.

10. A crimping apparatus as claimed in claim 9 wherein said cam member has a second cam surface, said first and second cam surfaces defining a wedge shape symmetrical about said radius, said cam member being movable into simultaneous engagement with said followers to simultaneously actuate said cams in opposite directions.

11. A crimping apparatus as claimed in claim 10 further comprising means for adjusting the normal radial position of said cam member.

12. A crimping apparatus as claimed in claim 10 wherein said cam means includes a pair of circumferentially spaced arcuate cams on said second body member concentric with said second longitudinal axis and mounted for limited rotation with respect thereto, said cams lying in the same plane as said cams on said first body member.

13. A crimping apparatus as claimed in claim 12 wherein each cam on said first body member engages a cam on said second body member so that all four cams are actuated simultaneously.

14. A crimping apparatus as claimed in claim 1 further comprising second spring means for biasing said dies radially outwardly into engagement with said cam means.

15. A crimping apparatus as claimed in claim 14 further comprising a roller follower disposed at the radially outer end of each of said dies in engagement with said cam means.

16. A crimping apparatus as claimed in claim 15 wherein each said roller follower engages each said die adjacent both axial ends thereof to thereby reduce the unit loads thereon and minimize any tilting moments.

17. A crimping apparatus as claimed in claim 15 wherein each said roller follower has a shaft which projects axially inwardly from the axially inward end of said die, said second spring means acting between said body member and said projecting shaft.

18. A crimping apparatus as claimed in claim 1 further comprising third spring means biasing said cam means away from said crimping position.

19. A crimping apparatus as claimed in claim 1 further comprising rigid plates affixed to each of said first and second body members and overlying said radial slots in each, a plurality of dowel pins extending through said plates and into said body members at points disposed between said slots to thereby strengthen said members.

* * * * *